United States Patent [19]

Pollock

[11] 4,031,861

[45] June 28, 1977

[54] PULVERIZED COAL FIRED PACKAGE BOILER

[75] Inventor: William Hunter Pollock, East Granby, Conn.

[73] Assignee: Combustion Engineering, Inc., Windsor, Conn.

[22] Filed: Apr. 5, 1976

[21] Appl. No.: 673,498

[52] U.S. Cl. ..... 122/327; 122/235 N

[51] Int. Cl.[2] ..... F22B 21/14

[58] Field of Search ..... 122/235 R, 235 N, 327, 122/328, 332, 333, 473, 476, 478, 510

[56] References Cited

UNITED STATES PATENTS

| | | | |
|---|---|---|---|
| 2,153,592 | 4/1939 | Rohrer | 122/327 |
| 2,393,205 | 1/1946 | Tiemeier | 122/347 |
| 2,526,416 | 10/1950 | Rehm | 122/235 |
| 2,583,599 | 1/1952 | Schoessow | 122/235 |
| 3,022,774 | 2/1962 | Hamilton et al. | 122/478 |
| 3,257,992 | 6/1966 | Bishop | 122/328 |
| 3,476,090 | 11/1969 | Shiekh | 122/478 |
| 3,841,275 | 10/1974 | Bisbee | 122/510 |

*Primary Examiner*—Kenneth W. Sprague
*Attorney, Agent, or Firm*—Wayne H. Lang

[57] ABSTRACT

A "package-type" boiler fired by pulverized coal that is adapted to be constructed and assembled in a shop then shipped as a completed unit to a given plant site. The boiler is provided with tube walls extending between longitudinally disposed drums that simultaneously provide optimum heat transfer along with internal support. The walls are bent to a configuration that imparts to the boiler a hopper-shaped bottom wall on opposite sides of an elongate throat through which solid products of combustion may be discharged.

4 Claims, 3 Drawing Figures

PULVERIZED COAL FIRED PACKAGE BOILER

BACKGROUND OF THE INVENTION

The present invention relates to steam generating equipment of a type known as "package boilers" that are assembled in a shop and then transported in their entirety to a given plant site. Package boilers have a distinct advantage over field erected boilers of comparable capacity inasmuch as significant savings may be realized by constructing the apparatus in a shop. In addition to the reduction in costs due to the time and manpower saved in their manufacture in a shop, further benefits are to be derived because the entire fabricating process may be performed under more nearly ideal conditions, thereby enhancing the quality of the finished product.

A significant disadvantage of existing shop built and assembled package-type boilers is that they have been universally designed for the utilization of gaseous and liquid fuel. With the shortage of such fuel, together with the comparative availability of coal, it becomes the principle object of this invention to provide a package-type boiler that is adapted for the burning of pulverized coal. The boiler is adapted to be supported by tubular wall members that are bent to form a furnace cavity having a hopper-shaped bottom on opposite sides of an elongate throat through which ash and other solid particles comprising the products of combustion may descend to a suitable disposal area.

A better understanding of the invention may be had by reference to the detailed description of a preferred embodiment thereof taken in conjunction with the accompanying drawings in which:

FIG. 1 is a side elevation of a boiler constructed in accordance with the present invention, FIG. 2 is a top plan view of the device illustrated in FIG. 1, and FIG. 3 is a cross-section as seen from line 3—3 of FIG. 2.

DESCRIPTION OF THE PREFERRED EMBODIMENT

Figure 1:
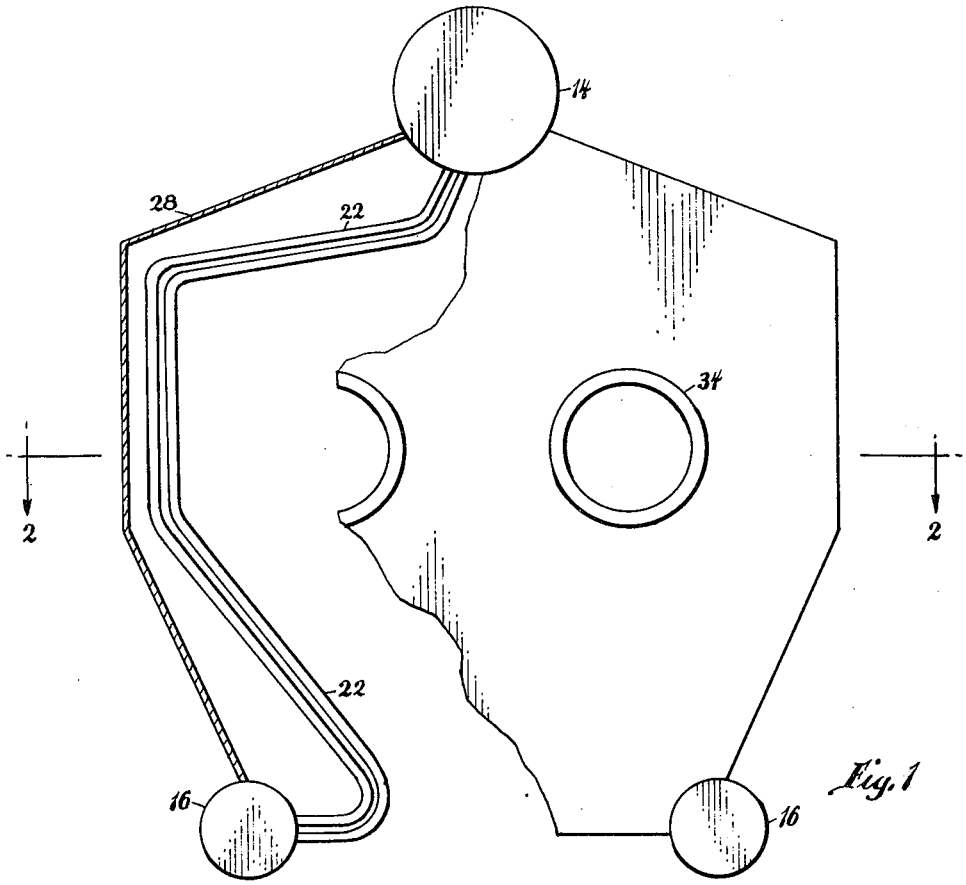
Figure 2:
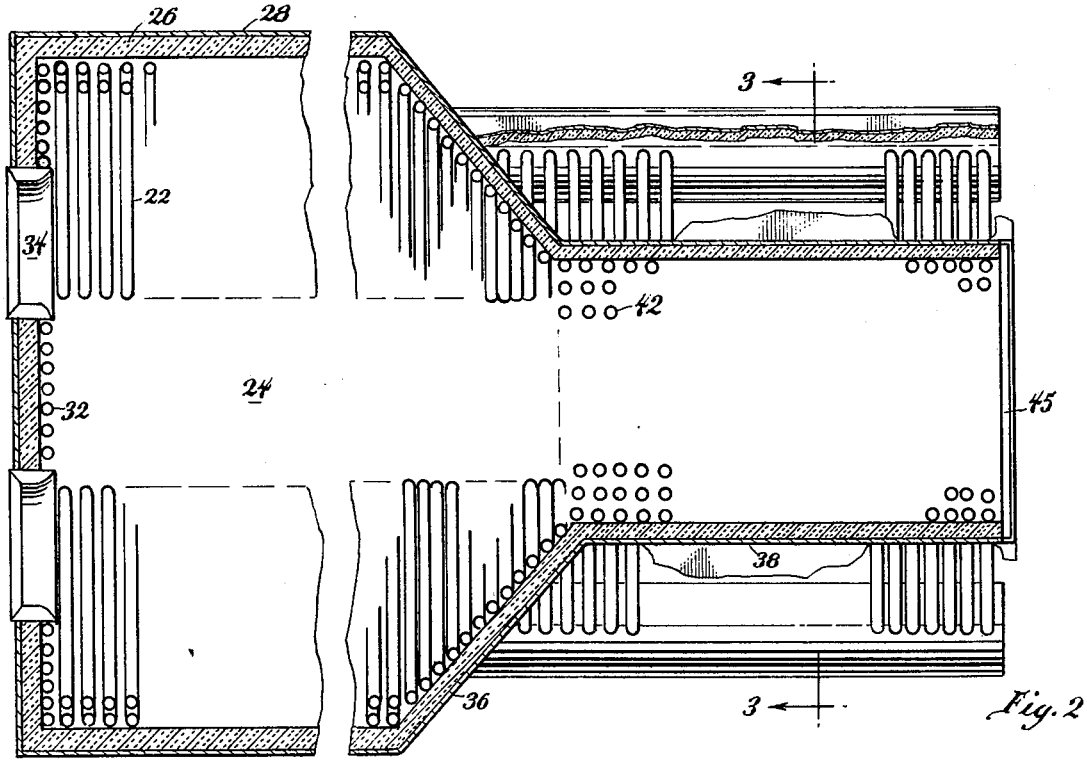
Figure 3:
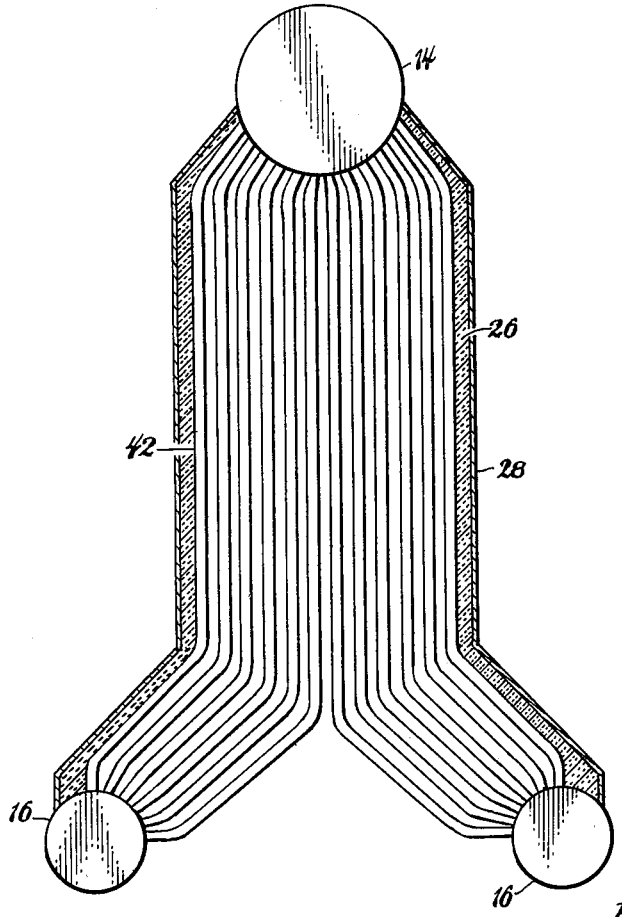

Referring more particularly to FIG. 1 there is shown a representation of a shop assembled package-type boiler. The boiler comprises a single upper drum 14 that extends horizontally along its apex, while a pair of lower horizontally disposed drums 16 extend parallel to the upper drum at the bottom of the boiler. A series of tubular members 22 connect each of lower drums 16 with the upper drum 14 to form a forward furnace section and a rear tube section through which fluid may circulate freely. The tubular members 22 of the furnace section are reversely bent to provide a bottom wall with an oppositely inclined configuration that forms a hopper with an elongate throat 24 therebetween conforming to the requirements of a furnace suitable for the combustion of ash producing pulverized coal.

The boiler furnace includes a front wall formed of refractory material 26 held by steel plates 28 and cooled by a conventional water wall 32. The front wall is provided with one or more openings 34 for the reception of burners adapted for the combustion of pulverized coal whereby said burners may discharge the products of combustion therefrom as an elongate flame substantially parallel to the elongate throat 24. The wall 36 of the boiler furnace tapers inwardly to a rectangular extension 38, filled with closely spaced boiler tubes 42 that extend from the lower drums to the upper drum to maintain optimum conditions for the transfer of heat from the hot gases flowing longitudinally through the boiler from a burner to an outlet in the end wall 45.

The unit is adapted to be supported on steel columns or piers extending under the drums 16 and built to include suitable ash receiving means for the superposed boiler.

While a preferred embodiment of my invention has been disclosed herein, various alterations may be made without departing from the spirit of the invention. The foregoing embodiment should, therefore, be considered as illustrative rather than restrictive of the invention, and the invention is intended to be limited only by the terms of the following claims.

I claim:

1. A shop assembled boiler comprising an upper drum that extends horizontally to form an elongate ridge along the apex of a boiler, a pair of lower drums positioned under the upper drum and spaced apart to comprise a base for said boiler, a housing with a front and rear portion enclosing the boiler, a plurality of tubular members connecting each lower drum to the upper drum formed to provide an open furnace cavity in the front portion of the housing having a hopper shaped bottom with tubular walls on opposite sides of an elongate throat, a bank of closely spaced tubes in the rear portion of the boiler formed to extend vertically between the lower drums and the upper drum and adapted to intercept hot gases that have traversed the cavity in the front portion of the boiler furnace, and coal burning apparatus penetrating the front portion of the furnace to exhaust hot products of combustion into the furnace cavity.

2. A shop assembled boiler as defined in claim 1 wherein the tubular members on opposite sides of the elongate throat are reversely bent to form the hopper-shaped bottom wall intermediate the lower drums.

3. A shop assembled boiler as defined in claim 1 wherein the hopper-shaped bottom extends longitudinally substantially parallel to the lower drums.

4. A shop assembled boiler as defined in claim 1 wherein the coal burning apparatus penetrates an end wall thereof to exhaust products of combustion into the furnace cavity vertically spaced from and substantially parallel to the elongate throat.

* * * * *